United States Patent [19]

Gauselmann

[11] 4,198,052

[45] Apr. 15, 1980

[54] SLOT MACHINE

[75] Inventor: Paul Gauselmann, Espelkamp, Fed. Rep. of Germany

[73] Assignee: ADP - Automaten GmbH, Espelkamp, Fed. Rep. of Germany

[21] Appl. No.: 946,332

[22] Filed: Sep. 27, 1978

[51] Int. Cl.[2] ..... A63F 5/04

[52] U.S. Cl. ..... 273/143 R

[58] Field of Search ..... 273/143 R, 143 A, 143 B, 273/143 C, 143 D, 143 E, 142 H, 142 HA, 138 A, 138 R, 1 R, 1 T, 1 U; 35/74, 77, 2, 3, 4; 235/1 C; 194/DIG. 11; 40/111, 114, 503, 504, 504; 340/378.1, 378.3, 378.5, 809, 810, 324 B, 324 S, 753, 754, 525, 286 M

[56] References Cited

U.S. PATENT DOCUMENTS

| | | | |
|---|---|---|---|
| 1,708,708 | 4/1929 | Tibbetts | 40/504 |
| 2,121,494 | 6/1938 | Babcock | 273/143 E |
| 2,594,159 | 4/1952 | Hanf | 273/143 R |
| 2,846,227 | 8/1958 | Wickham | 273/143 R X |
| 3,733,075 | 5/1973 | Hooker et al. | 273/143 R X |
| 3,872,463 | 3/1975 | Lapeyre | 340/762 |

FOREIGN PATENT DOCUMENTS

| | | | |
|---|---|---|---|
| N 10258 | 12/1956 | Fed. Rep. of Germany | 273/142 H |
| 1247721 | 8/1967 | Fed. Rep. of Germany | 273/143 R |
| 1253500 | 11/1967 | Fed. Rep. of Germany | 194/DIG. 11 |
| 337895 | 3/1904 | France | 273/143 E |
| 497937 | 9/1954 | Italy | 273/142 H |
| 1120269 | 7/1968 | United Kingdom | 273/143 R |

*Primary Examiner*—Richard C. Pinkham
*Assistant Examiner*—Arnold W. Kramer
*Attorney, Agent, or Firm*—Oblon, Fisher, Spivak, McClelland & Maier

[57] ABSTRACT

A slot machine with at least three coaxially disposed wheels having a plurality of playing symbols on the peripheries thereof, wherein a plurality of columns of windows, one column for each window, are disposed in front of the wheels to enable viewing of a preselected number of symbols of each wheel and to define a plurality of win-lines for play of the slot machine. The windows of the plural columns are disposed in a triangular configuration, with one end window column permitting viewing of only one symbol and with window columns of adjacent wheels revealing greater numbers of symbols in direct proportion to the distance from the one end column, the wheel associated with the one end window column being the last to stop rotating during play of the slot machine.

6 Claims, 2 Drawing Figures

SLOT MACHINE

BACKGROUND OF THE INVENTION

1. Field of the Invention

This invention relates to a slot machine with three or more wheels which are coaxially disposed side-by-side, and which carry on their peripheries in the different positions of rest symbols showing the results of play, and a housing enclosing the wheels with a viewing window in front thereof through which at least one symbol of each wheel is humanly visible.

2. Description of the Prior Art

Slot machines of the above type have long been known wherein the viewing window enables viewing of a single field of each wheel. The single fields do indeed furnish a ready overview of the results of play, but as a result the possibilities of winning and the number of winning combinations are also concurrently limited to these simple groupings.

An improved configuration for a slot machine of the type described above provides two pairs of windows, each pair having one window above the other, for simultaneous display of two symbols on each of the outer wheels and a single window in the middle. This provides two criss-crossing "win-lines", on at least one of which certain symbols must lie for a winning combination. When, therefore, the different wheels successively stop in the course of a play, the player can observe whether a win, if any, results along one or the other win-line.

Obviously a larger number of win-lines would stimulate additional urge to play, but the difficulty here is that with increasing number of windows and win-lines, the display becomes difficult to see and comprehend.

SUMMARY OF THE INVENTION

Accordingly, one object of this invention is to configure a slot machine of the type described above having additional viewing windows wherein in spite of the inclusion of additional windows, the display symbols remain easily visible and comprehensible.

This and other objects are achieved according to the invention by having a plurality of windows disposed in a nearly triangular basic configuration, which shows one symbol on a wheel at one side through a single window and two or more symbols on the other wheels through window slots extending along more and more of the periphery of each successive wheel. The relative widening or narrowing of the window arrangement in the basic form of a triangle across the coaxially disposed wheels affords the player the obvious possibility of projecting an expanded or narrowed chance, respectively, of winning. The pertinent win-lines remain easily visible and can be traced as play proceeds, i.e. as the different wheels successively come to a stop, without prematurely disclosing the player's final set of combinations.

In a preferred embodiment, a single window for one symbol is disposed on an end wheel, two windows for symbols on the adjoining wheel and three windows for symbols on the next wheel. This yields, firstly, two straight win-lines through the single window, the two windows of the middle wheel and the two outer windows in the three-window group. Furthermore, up to four additional win-lines can be provided by allowing non-straight-line combinations of windows.

With the advantage of symmetric arrangement and a limitation of the display field to the best discernible portion of the wheels nearest the player, an offset of about half the window height can be provided between neighboring columns of windows.

In an especially advantageous embodiment for a slot machine, in which the wheels come to a stop in the usual way one after another, the triangular shape of the plurality of window tapers to a single window over the lastly stopped wheel. This promotes the initial appearance of a relatively high prospect of winning because of the initially large number of winning combinatins contemplated, and increasingly stimulates excitement with continuing play, until finally the last wheel to stop determines the overall result with its single field. In this way the desire to play can be heightened without thereby going beyond the bounds of economically supportable win payoffs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
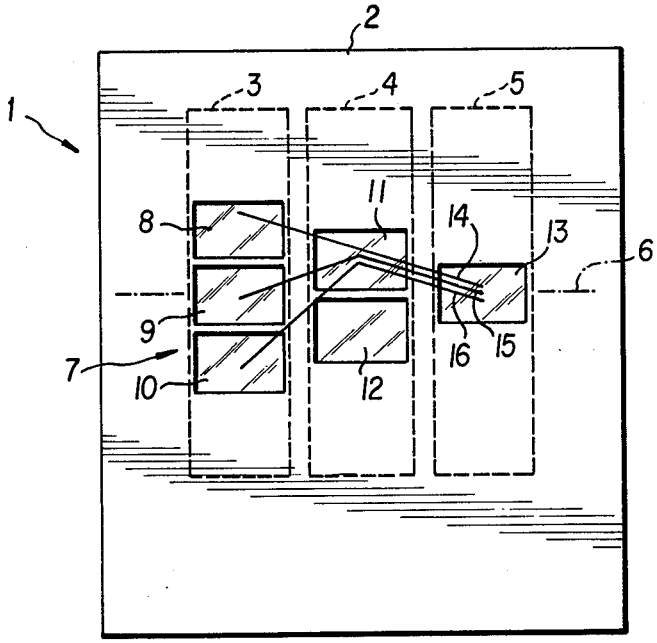
FIG. 1 is a schematical representation of a slot machine with a window arrangement for three wheels.

Referring now to the drawings, wherein like reference numerals designate identical or corresponding parts throughout the several views, and more particularly to FIG. 1 thereof, a slot machine generally designated by the number 1 is schematically represented, with a housing 2 indicated in outline, within which are disposed wheels 3, 4 and 5, shown dashed, side-by-side along a common coaxial axis 6. The housing 2 exhibits (in its front side) a window arrangement, generally denoted as by the numeral 7, made up of windows 8, 9 10, 11, 12 and 13. These windows are arranged in the form of a triangle with its "apex" to the right, i.e. the single window field 13.

THe size and location of the window corresponds to the size and position of the symbols, not shown, on the periphery of each wheel when in one of the prescribed rest positions. In the present example of embodiment the wheel 3 is the first to stop and wheel 5 the last.

When wheel 3 stops, the player sees three symbols in the windows 8, 9 and 10, one or even more of which may presage a win. When wheel 2 stops, this chance of winning can be preserved, the player being permitted to count both window 11 and window 12 towards his expectation of winning. Whether the hoped for result of play is actually obtained is finally indicated by the display in the sngle window 13. This concentration on the single indication of the last wheel to stop produces a climax of excitement, which, together with the relatively high initial chance of winning,, particularly arouses a desire to play.

To illustrate the possible winning combinations, connecting lines are drawn between the windows, defining the so-called "win-lines" 14, 15 and 16. These are the win-lines between the wheels as far as window 11 is concerned. Obviously there are three more mirror-image win-lines, not shown for reasons of clarity, when window 12 is taken into consideration.

Figure 2:
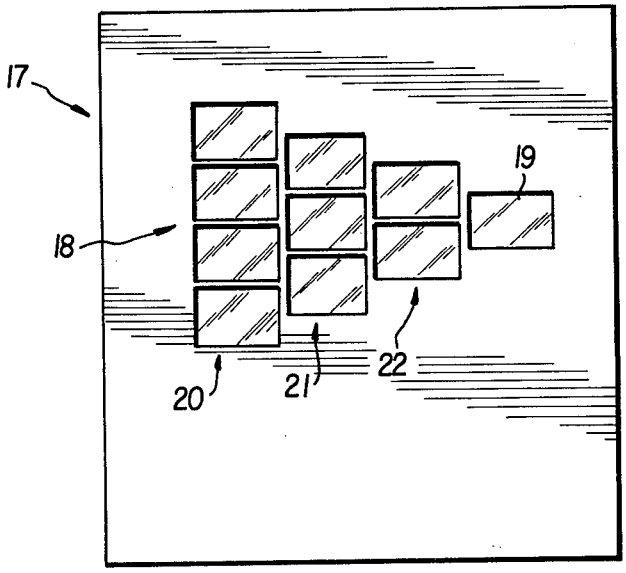
FIG. 2 is a schematical representation of a slot machine with a window arrangement for four wheels.

FIG. 2 shows a very similar slot machine 17 where the number of wheels in increased to four. The resulting window arrangement 18 consists again of windows in a vertical column array, where the number of windows per column decreases from left to right to a single window 19. A column 20 with four windows is on the left and the two successive columns to the right are denoted by 21 and 22. Obviously such a window arrangement offers a much higher number of possible win-lines, it beng understood that they need not all be allowed for determining a win. Rather, a suitable selection from among them can be allowed here. Customarily a corresponding key to winning is explained by a suitable label on the machine.

In both the window arrangement 7 of FIG. 1 and window arrangement 18 of FIG. 2 it is seen that the windows (arranged in a column) for one wheel are shifted vertically with respect to the windows of an adjoining wheel by about half the window height. This is in consideration of the rest positions of the wheels behind them. The shift between the windows and rest positions enables discernment of the displyed symbols in the region of the wheels nearest the front wall of the housng 1 or 17, and easy viewing by the player without distortion from his perspective point of view. Besides there is produced a suitably compact, symmetric and essentially triangular window arrangement.

Instead of the symmetric window arrangement shown in FIGS. 1 and 2, the basic form of a right-angled triangle can also be advantageious. The windows for adjacent wheels exhibit then no relative offset in the direction of the wheel circumference. Rather, a longest row of windows including the single window of an end wheel runs transverse to the wheel circumference and stepwise shortened rows of windows run parallel thereto.

It is understood that the coaxial side-by-side arrangement of the wheels is not bound to the horizontal orientation of the axis as, for instance, the axis 6 in FIG. 1. An also easily realized vertical coaxial side-by-side arrangement, i.e. an arrangement with coaxial wheels situated one above another, is also quite possible.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a slot machine having at least three wheels disposed coaxially in side-by-side arrangement, wherein each wheel is provided with a plurality of symbols around the peripheries thereof such that with said wheels in prescribed rest positions said symbols define the results of play, said slot machine having a housing essentially enclosing said wheels, said housing having a plurality of windows through which at least one symbol of each wheel is visible, the improvement comprising:

said windows disposed in a plurality of columns, each dedicated to a single wheel, to define a triangular configuration wherein one end window column enables viewing of only a single symbol of the wheel associated with said one end window column, and wherein the number of visible symbols of successive window columns increases in proportion to the relative disposition of each wheel with respect to said one end window column, with the other end window column enabling viewing of the greatest number of said symbols on the wheel associated therewith.

2. A slot machine according to claim 1, further comprising:

said window column for said one end wheel comprising a single window for permitting viewing of a single symbol on the periphery of said one end wheel;

said window column for a second wheel immediately adjacent said one end wheel comprising two windows for permitting viewing of two symbols on the periphery of said next wheel; and, said window column of a third wheel immediately adjacent said second wheel comprising three windows for permitting viewing of three symbols on the periphery of said third wheel.

3. A slot machine according to claim 2, wherein the windows of said window columns are comparably dimensioned, further comprising:

windows of adjacent window columns shifted approximately one half a window height relative to windows of the adjacent window columns.

4. A slot machine according to claim 1, wherein after initiation of a play the wheels come to a stop in succession, further comprising:

said triangular configuration of the plurality of windows converges to a single window over the last wheel to stop.

5. A slot according to claims 2 or 4, further comprising:

a plurality of windows forming a right-angled triangle, in which the windows of adjacent wheels are aligned in a plurality of rows.

6. A slot machine according to claim 1 wherein said wheels are vertically coaxially disposed side-by-side along a vertical axis.

* * * * *

UNITED STATES PATENT AND TRADEMARK OFFICE

CERTIFICATE OF CORRECTION

PATENT NO. : 4,198,052

DATED : April 15, 1980

INVENTOR(S) : PAUL GAUSELMANN

It is certified that error appears in the above-identified patent and that said Letters Patent are hereby corrected as shown below:

Please insert the following information:

[30]--Foreign Application Priority Data
Oct. 19, 1977, Feb. Rep. of Germany 7732246 --.

Signed and Sealed this

*Twenty-fourth* Day of *June 1980*

[SEAL]

*Attest:*

SIDNEY A. DIAMOND

*Attesting Officer*

*Commissioner of Patents and Trademarks*